US007263933B2

(12) United States Patent
Ebbufoama

(10) Patent No.: US 7,263,933 B2
(45) Date of Patent: Sep. 4, 2007

(54) INCINERATOR FURNACE CONDENSERS AND METHODS OF USING

(76) Inventor: Caius E. Ebbufoama, 5802 Annapolis Rd., #706, Bladensburg, MD (US) 20710

( * ) Notice: Subject to any disclaimer, the term of this patent is extended or adjusted under 35 U.S.C. 154(b) by 0 days.

(21) Appl. No.: 10/630,902

(22) Filed: Jul. 31, 2003

(65) Prior Publication Data

US 2005/0022704 A1 Feb. 3, 2005

(51) Int. Cl.
*F23B 7/00* (2006.01)

(52) U.S. Cl. ..... 110/342; 110/346

(58) Field of Classification Search ..... 110/221, 110/210, 233, 342, 346; 210/280, 800, 774; 95/188, 165, 290, 288
See application file for complete search history.

(56) References Cited

U.S. PATENT DOCUMENTS 3,623,438 A * 11/1971 Cardinal, Jr. ..... 110/221
4,133,273 A * 1/1979 Glennon ..... 110/346
4,846,081 A * 7/1989 Homer et al. ..... 110/186
4,949,652 A * 8/1990 Hadley ..... 110/215
5,271,162 A * 12/1993 Kunz et al. ..... 34/493

* cited by examiner

*Primary Examiner*—Kenneth Rinehart
(74) *Attorney, Agent, or Firm*—Blank Rome LLP

(57) ABSTRACT

A method for processing waste material into fuel or other useful substances without polluting the air comprising the steps of:

a. Introducing waste material into a storage chamber which allows the liquid to drain into a tank,
b. Moving the waste to a storage chamber where it is burned,
c. Moving the emissions and dust to a cleaning and burning chamber where they are further condensed, Or a. Pasteurizing sludge and raw sewage and using the gases produced for heat energy,
b. Forming a solid of the liquid substances by adding ground corn and/or millet to them and using the solid for fuel.

5 Claims, 2 Drawing Sheets

INCINERATOR CHAMBERS

INCINERATOR CHAMBERS

INCINERATOR FURNACE CONDENSERS AND METHODS OF USING

FIELD OF INVENTION

The present invention relates to an apparatus and process for the incineration and/or condensing of municipal waste.

SUMMARY

The condenser is an incinerator technology made up of three different units; while every unit performs different duties, they complement one another. Each unit has more than one chamber that it operates.

The technology performs the following four duties:

1. Turns vapor substances (emissions), such as, nitrogen, sulfur oxide, carbon monoxide, carbon dioxide, sodium sulfite, dust and any other vaporous substance into a liquid state;
2. Turns liquid substances into a solid compound;
3. Turns these compounds into energy producing fuel; and
4. Turns municipal waste into ashes, which are subsequently converted into liquid waste.

DESCRIPTION OF THE DRAWINGS

FIG. I shows the municipal waste processing unit.

FIG. II shows the emission condenser unit.

Figures 1, 2:
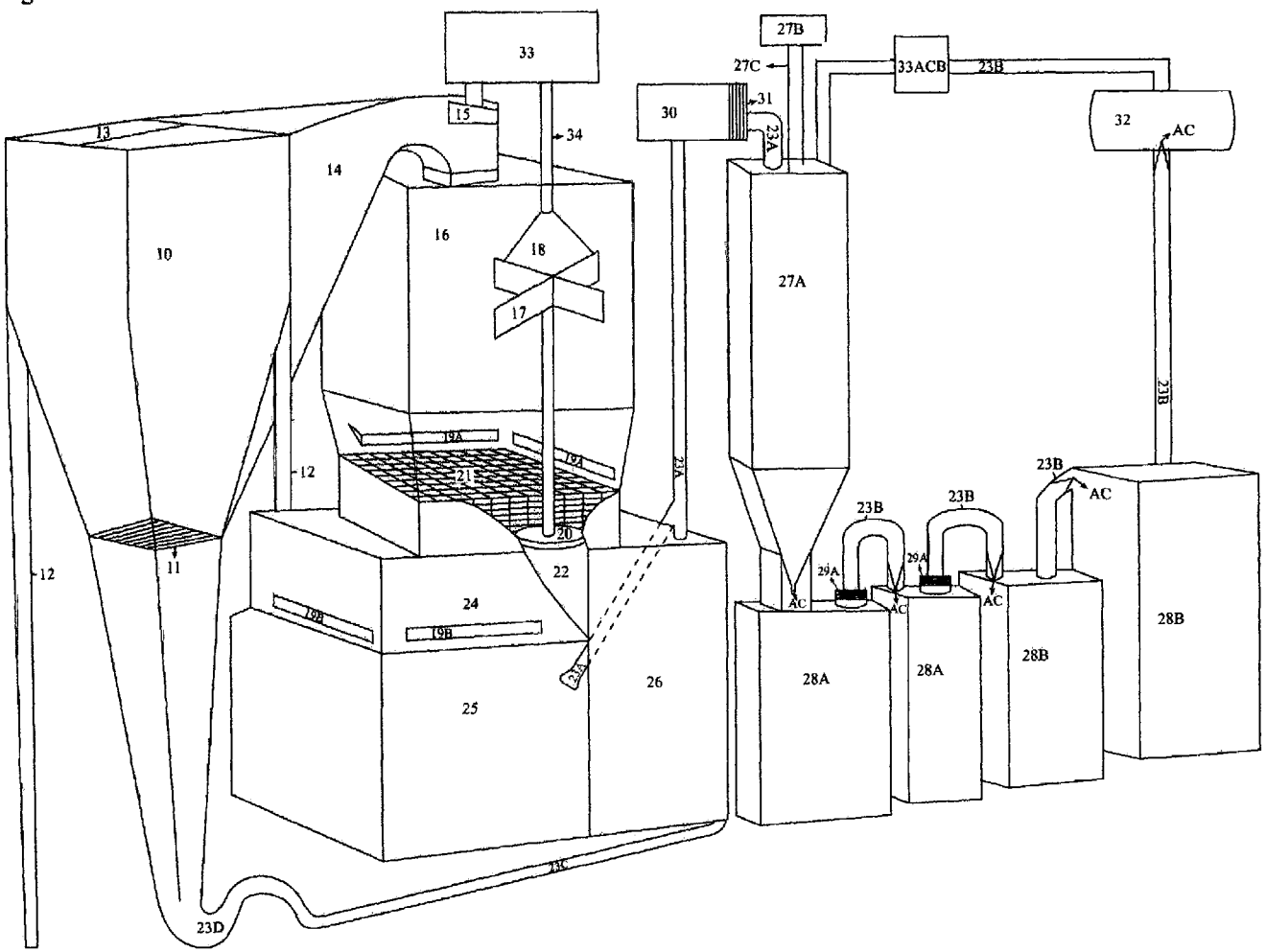
Figure 3:
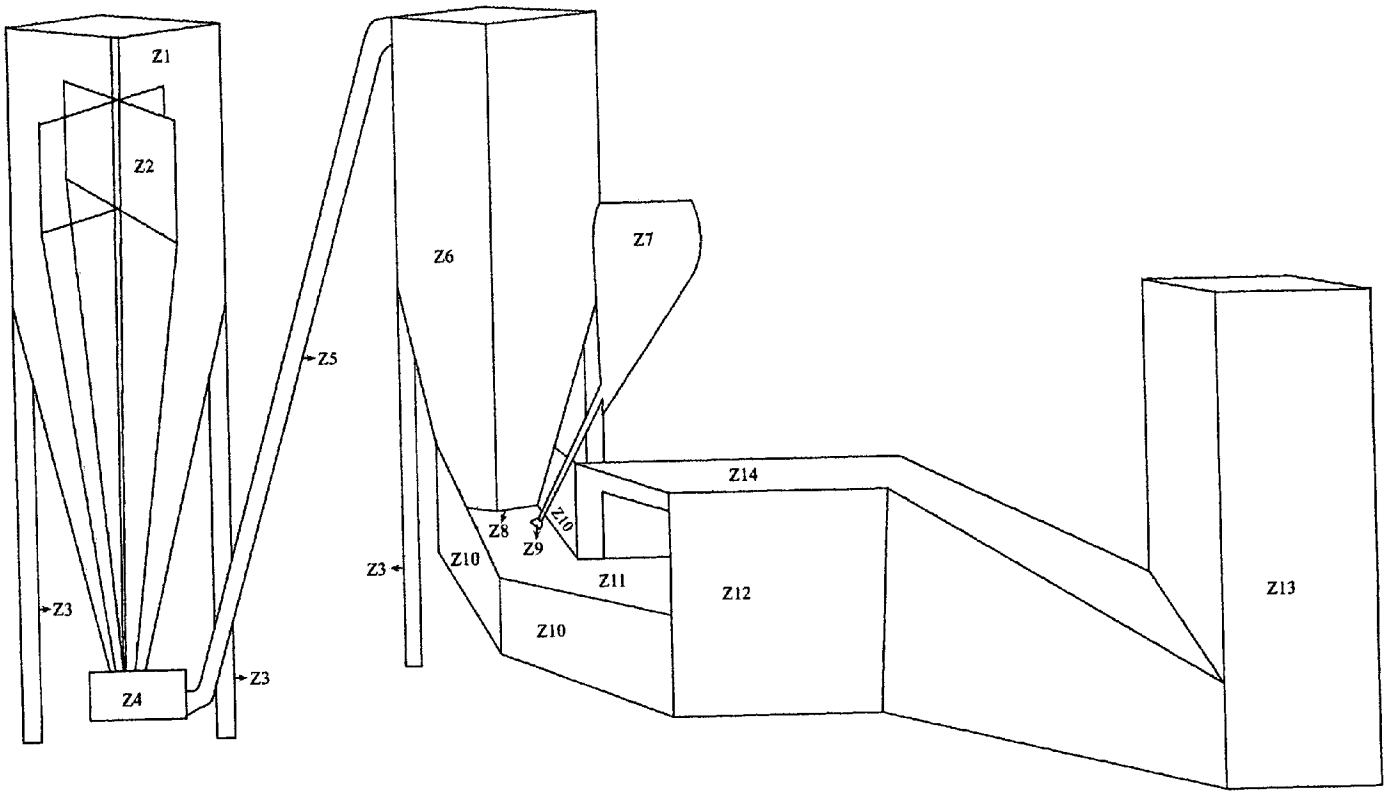

FIG. III shows the raw sewage and chemical waste-processing unit.

DETAILED DESCRIPTION OF THE INVENTION

Description of FIG. I

FIG. I shows the municipal waste-processing unit made up of six (6) primary chambers and sixteen (16) secondary chambers. All secondary chambers are designed to complement the six primary chambers. The storage chamber 10 is for the collection of municipal waste. The leachate water tank 11 is for the municipal waste drain off. The legs 12 are the chamber stands. 13 is the automatically controlled electronic door and 14 is the waste transit escalator. The hydraulic chamber automatic door lock is shown as 15. 16 denotes the municipal waste condenser (burner) chamber. The chamber cleaner and waste level gage 17 is connected to the gas entrance line. 19A is the air pressure in-let used to ignite fire while 19B is the air-cooling entrance. (Its functions may not be necessary.) The hydraulic door lock 20 prevents ashes, air pressure, gases and dust that is in chamber 16 from entering chamber 26 and chamber 25 during condensation initiation. The floor of chamber 16 is labeled 21 and it is made of heat conductors. 22 is the residue and air pressure passage way with an automatically, electronically controlled door lock at the end of it. The lock prevents air pressure, ashes and dust from entering chamber 26 and forcing them into chamber 25. The air vacuum pipe is 23A and 23C and 23D are leachate water pump lines. The water-cooling tank for chamber 16 is 24. The ash and dust residing chamber is 25. The filtration chamber 26 filters the air and emissions before they enter the unit of FIG. II. The vacuum machine is 30 and the air filter is number 31. The air compressor tank is 33, while the gas line is 34.

Description of FIG. II

FIG. II units are the gas and dust control chambers. Their functions are to clean all emissions that enter the unit and condense them into a solid form, rather releasing them into the environment. 27A is the emissions cleansing chamber operating at approximately 1,500 degrees Celsius. The emission in-let pumping machine is 27B and AC is the pressure hold and release outlet. 28A are the water boiler units and 28B are the water cooler units. The air vacuums are labeled 23B and 29A are the filters. 32 is the escaped air tank. 33ACB is the water sprinkler. The leachate water vacuum line is 23C and the leachate water tank is 23D.

Description of FIG. III

The deposit, treatment and mixing chamber for raw sewage and chemical waste is Z1. Z2 is the mixer. Z3 are the chamber stands. The raw sewage-pumping machine is Z4, while the raw sewage deposit pipeline is Z5. Z6 is the formation tank; Z7 is the grease tank; and Z8 is the droop mouth. The spray pipe is Z9. The raw sewage transport escalator wall is Z10 and Z11 is the raw sewage transport escalator. The raw sewage drying and burning chamber is Z12 and it spins at 25 mph. Z13 is a storage chamber.

Processing Description of FIG. I

Chamber 10 is a storage chamber for municipal waste. During the condensation process, waste is moved from chamber 10 to chamber 16 by the escalator carrier. As the escalator moves, the hydraulic door opens automatically to allow waste to enter chamber 16. When the waste in chamber 16 reaches the gage level, the escalator automatically turns off, allowing the control door to close seal off gases, dust, odor and air from escaping. Then gas is introduced into chamber 16 through the gas line and the ignition switch is turned on to ignite a fire spark. At the same time hot air pressure is introduced into chamber 16 through pipe holes 19A. The hot air pressure helps the condensation in chamber 16. It flushes ashes, emissions, and dust out of chamber 16 into the passageway 22 and finally, to chamber 25 where they reside before they are moved to a landfill or used for other purposes.

Chamber 26 filters the emissions and dust before they enter the FIG. II unit. The emissions enter chamber 27A, which is an emission gases, dust and leachate water cleansing and burning chamber; the substances are turned into a mixture of vapors before they are released to chamber 28A for cleansing. The cleaned vapor is then released to chamber 28B where it is condensed into a solid.

Processing Description of FIG. II

FIG. II is the emissions, dust and leachate water cleansing and condensing unit. Its purpose is to collect emissions, dust and leachate water from FIG. I and FIG. III units. The substances are cleansed at a temperature of approximately 1500 degrees Celsius in chamber 27A and released into chamber 28A as vapor for further cleansing.

Turning these substances into vapor and the final stage of cleaning is done by forcing the vapor to loop out of the boiling tank 27A through the AC pressure holder into chamber 28A. The water temperature in 28A is 150 degrees Celsius and above. Chambers 28B collect the vapor and freezes it into a solid form at a temperature of −150 degrees Celsius. Subsequently the solid is returned to a liquid state, filtered and the residue is pumped into FIG. III unit for condensation.

Processing Description of FIG. III

FIG. III unit processes liquid substances that include that include water, ammonia, gasoline, alcohol, other solvents, thinners, methyl ethyl ketone, oil, and chemicals, such as, nitrogen oxide, anhydrous hydrogen chloride, sodium chlorate, hydrogen peroxide, sodium sulphite, and acid.

In Z1 chamber, sludge sewage and raw sewage are turned into a solid compound by the addition of ground corn and/or millet, which absorb the liquid. The reason for using two at the same time is because they complement each other and become more absorbent. There is no standard of measurement for use in this process and the measurement used can be based on the choice of how solid an individual wants the compound to be. The purpose for mixing the three substances into one solid compound is to avoid heavy dripping. The reason for grinding corn and millet before using them is because they absorb liquid substances faster. The compound from Z1 is pumped into Z6 chamber to go through the final condensation treatment, which involved adding more ground corn and/or millet and oil. The purpose of the oil is to prevent the compound from sticking to the chamber walls. Cooking oil is preferred.

Energy is cultimated from energy producing substances in two different formats:

1. When raw sewage, sludge sewage, or animal manor are moved into chamber Z1, the chamber is heated and kept at a temperature of 380 deg. Celsius to 420 deg. Celsius to pasteurize the substances in the chamber, as a result, the substances produce gases. The gases are extracted through a pipeline to a gas storage tank to produce heat energy.
2. The second energy producing substance is the solid compound made from the liquid substances mixed with ground corn and millet; they become fuel to power electric generators. During the process of drying the substances one and a half tons of solid substances are produced for every two tons of wet substance. 10 tons of dried solid substances will produce one MW/hour of electricity, when used to produce electricity energy due to its calorific values.
3. The dried substances could be burned if not needed for energy producing fuel. One ton of ashes are produced for every twenty tons of the solid substance burned.

What is claimed is:

1. A method for processing sludge and raw sewage comprising the steps of:

a. pasteurizing sludge and raw sewage and using the gases produced for heat energy, leaving a liquid remainder, and b. forming a solid fuel from the liquid remainder by adding ground corn and/or millet to the liquid.

2. The method of claim 1, wherein the pasteurizing temperature is from 380° C. to 420° C.

3. A method for processing waste material to produce fuel or other useful substances comprising the steps of:

a. introducing waste material into a storage chamber which allows a liquid to drain into a tank b. moving the waste to a condenser chamber where it is burned, and c. moving emissions and dust to a cleaning and burning chamber where they are further condensed wherein the emissions and dust are cleansed at a temperature of approximately 1500° C., and condensed into a solid at a temperature of approximately −150° C.

4. The process of claim 3, wherein the waste material in the storage chamber is moved to the condenser chamber by an escalator carrier.

5. The process of claim 3, wherein gas for burning the waste enters through a gas line and an ignition device creates a spark to ignite a fire in the chamber.

* * * * *